US007117831B2

(12) United States Patent
Methley

(10) Patent No.: US 7,117,831 B2
(45) Date of Patent: Oct. 10, 2006

(54) ENGINE WITH VARIABLE LIFT VALVE MECHANISM

(75) Inventor: Ian Methley, Oxfordshire (GB)

(73) Assignee: Mechadyne PLC, Oxfordshire (GB)

( * ) Notice: Subject to any disclaimer, the term of this patent is extended or adjusted under 35 U.S.C. 154(b) by 0 days.

(21) Appl. No.: 10/534,995

(22) PCT Filed: Nov. 12, 2003

(86) PCT No.: PCT/GB03/04864

§ 371 (c)(1),
(2), (4) Date: May 27, 2005

(87) PCT Pub. No.: WO2004/046512

PCT Pub. Date: Jun. 3, 2004

(65) Prior Publication Data

US 2006/0011160 A1 Jan. 19, 2006

(30) Foreign Application Priority Data

Nov. 16, 2002 (GB) ..... 0226842.3

(51) Int. Cl.
*F01L 1/34* (2006.01)

(52) U.S. Cl. ..... 123/90.16; 123/90.15; 123/90.39

(58) Field of Classification Search ..... 123/90.16, 123/90.15, 90.39, 90.31, 90.6, 90.45, 90.41
See application file for complete search history.

(56) References Cited

U.S. PATENT DOCUMENTS 4,397,270 A 8/1983 Aoyama
6,354,255 B1 * 3/2002 Methley et al. ..... 123/90.16
6,425,357 B1 7/2002 Shimizu et al.

FOREIGN PATENT DOCUMENTS

| | | |
|---|---|---|
| DE | 197 08 484 | 9/1998 |
| EP | 0 717 174 | 6/1996 |
| EP | 1 072 762 | 1/2001 |

* cited by examiner

*Primary Examiner*—Thomas Denion
*Assistant Examiner*—Zelalem Eshete
(74) *Attorney, Agent, or Firm*—Smith-Hill and Bedell

(57) ABSTRACT

An internal combustion engine is described having a valve mechanism which comprises a gas exchange poppet valve, a camshaft rotatable in synchronism with the engine crankshaft and having a cam for operating the valve, a valve actuator acting on the popper valve to open and close the valve, and an intermediate rocker having a follower acted upon by the cam and a contoured surface that acts on the valve actuator to open and close the valve in synchronism with the rotation of the cam, the intermediate rocker having a pivot axis that is movable in order to vary the valve lift. In the invention, the intermediate rocker is mounted about a pivot shaft that is moved to vary the valve lift in response to rotation of the pivot shaft about its own axis, and the pivot shaft is constrained to move along a path which is such that, while the cam follower is on the base circle of the cam, the valve actuator remains stationary and a substantially constant clearance is maintained between the contoured surface of the intermediate rocker and the valve actuator during displacement of the pivot shaft along the path.

10 Claims, 3 Drawing Sheets

ENGINE WITH VARIABLE LIFT VALVE MECHANISM

This is a national stage application filed under 35 USC 371 based on International Application No. PCT/GB2003/004864 filed Nov. 12, 2003, and claims priority under 35 USC 119 of United Kingdom Patent Application No. 0226842.3 filed Nov. 16, 2002.

FIELD OF THE INVENTION

The present invention relates to An internal combustion engine having a valve mechanism which comprises a gas exchange poppet valve, a camshaft rotatable in synchronism with the engine crankshaft and having a cam for operating the valve, a valve actuator acting on the poppet valve to open and close the valve, and an intermediate rocker having a follower acted upon by the cam and a contoured surface that acts on the valve actuator to open and close the valve in synchronism with the rotation of the cam, the intermediate rocker having a pivot axis that is movable in order to vary the valve lift.

BACKGROUND OF THE INVENTION

The known BMW Valvetronic valve mechanism, as described for example in EP 1039103, operates in the manner described above and is believed to constitute the closest published prior art to the present invention. In the known mechanism, the intermediate rocker pivots about a point at its upper end which can be moved from side to side by means of a cam. At a point between its two ends, the intermediate rocker carries the cam follower, its lower end being contoured and in contact with the valve actuating rocker.

The valve mechanism described in EP 1039103 suffers from several disadvantages. First, the mechanism requires a special cylinder head that increases the overall height of the engine and can cause packaging problems. Second, the intermediate member is not positively retained in the cylinder head and is merely allowed to free float, being urged against its various contact points (at the cam and at its pivot) by means of a spring. Third, a complex control mechanism is required to enable the valve events of several valves to be controlled at the same time.

SUMMARY OF THE INVENTION

In accordance with the present invention, an internal combustion engine as set forth above is characterised in that the intermediate rocker is mounted about a pivot shaft that is moved to vary the valve lift in response to rotation of the pivot shaft about its own axis, and the pivot shaft is constrained to move along a path which is such that, while the cam follower is on the base circle of the cam, the valve actuator remains stationary and a substantially constant clearance is maintained between the contoured surface of the intermediate rocker and the valve actuator during displacement of the pivot shaft along the path.

In the present invention, the intermediate rocker is mounted on a pivot shaft and is therefore positively retained in the engine. Furthermore, because movement of the pivot shaft is effected by simply rotating it about its own axis, the requirement for a complex control mechanism is obviated. Because the intermediate rocker no longer free floats, the invention also ensures that the clearance between the intermediate rocker and the valve actuator is not affected by position of the pivot shaft.

In the preferred embodiment of the invention, the pivot shaft is located on the intermediate rocker between the cam follower and the contoured surface that actuates the valve. Consequently, the pivot shaft is located lower in the engine, avoiding the need to increase the overall height of the cylinder head. This also has the effect of reducing the rotational inertia of the intermediate rocker.

It is also important to note that whereas in the prior art the intermediate rocker pivots about a single point at its upper end, in the present invention the intermediate rocker is pivoted about a shaft and it therefore less prone to wear.

The valve actuator is preferably itself a rocker (hereinafter termed the valve actuating rocker to distinguish it from the intermediate rocker) pivoted at one end, acting on the valve at its other and having between its ends a part-cylindrical contact surface of a roller follower acted upon by the contoured surface of the intermediate rocker.

In order to maintain a constant clearance between the valve actuating rocker and the contoured surface of the intermediate rocker, it is preferred to provide a link to constrain the pivot shaft of the intermediate rocker to move in an arc centred on the axis of the roller or cylindrical contact surface of the valve actuating rocker.

In order to move the pivot shaft of the intermediate rocker, it is preferred for the shaft to pass through a bore in an eccentric sleeve rotatably supported in a stationary bearing block of the engine. The rotation of the eccentric sleeve will in this case result in translation of the axis of the shaft.

The eccentric sleeve is advantageously coupled to the shaft by means of a pin which is free to slide relative to at least one of the sleeve and the shaft. In practice, the shaft will normally be connected to at least two sleeves supported in bearing blocks and by rotating the shaft, all the sleeves will be moved by equal amounts.

The movement of the pivot shaft of the intermediate rocker will not only result in the valve lift being varied but in a change in the timing of the valve event. It is possible to provide a phase change mechanism between the engine crankshaft and the camshaft to compensate for, or increase, this modification of the engine timing as desired.

Conveniently, the fixed point on which the valve actuating rocker rests in the engine comprises a hydraulic lash adjuster.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 6:
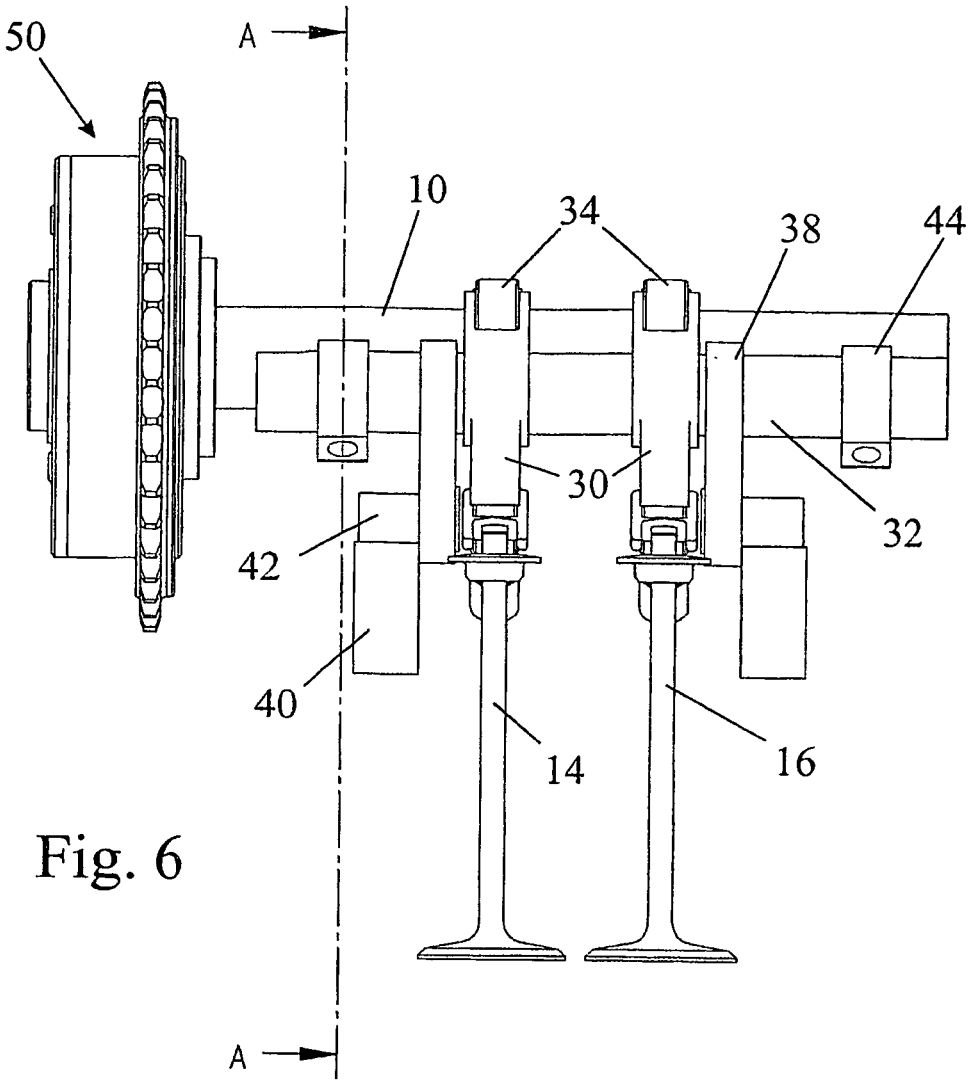
FIG. 6 shows a side view of the valve mechanism complete with a phase change mechanism for varying the phase of the camshaft relative to the engine crankshaft.

The valve mechanism in the drawings is fitted to a cylinder head of an engine which, in the interest of clarity has not been shown in full. A camshaft 10 driven by the engine crankshaft through a phase change mechanism 50 (see FIG. 6) is suitably journalled in the cylinder head. the camshaft 10 carries cams 12 which act by way of the mechanism to be described below on two gas exchange poppet valves 14, which may be intake or exhaust valves. Each poppet valve 14 is slidable in a valve guide 16 that is driven into the cylinder head. When the valve is closed by a spring which is not shown, the enlarged head of the valve 14 seals, against a valve seat 18 that also forms part of the engine cylinder head.

Each valve 14 is opened and closed by a valve actuating rocker 20, herein termed the valve actuating rocker, which is pivoted at one end on a hydraulic lash adjuster 22 (shown in FIGS. 2 to 5). The opposite end of the valve actuating rocker 20 acts on the upper end of the stem of the valve 14 and a follower roller 24 is fitted to the valve actuating rocker 20 near its mid-point.

An intermediate rocker 30 is pivotably mounted on a shaft 32. One end of the intermediate rocker 30 carries a cam follower roller 34 and on its opposite end there is formed a contoured surface 36 which acts on the follower roller 24 of the valve actuating rocker 20. As the cam 12 rotates, the intermediate rocker pivots about the shaft 32 and its contoured surface 36 acts on the roller 24 to pivot the valve actuating rocker 20 about the hydraulic lash adjuster 22 and thereby open and close the valve 14.

Because of the shape of the contoured surface 36, movement of the pivot shaft 32 from left to right as viewed in FIGS. 2 to 5 has the effect of reducing the valve lift. This can best be seen from a comparison of FIGS. 2 to 5.

Figure 1:
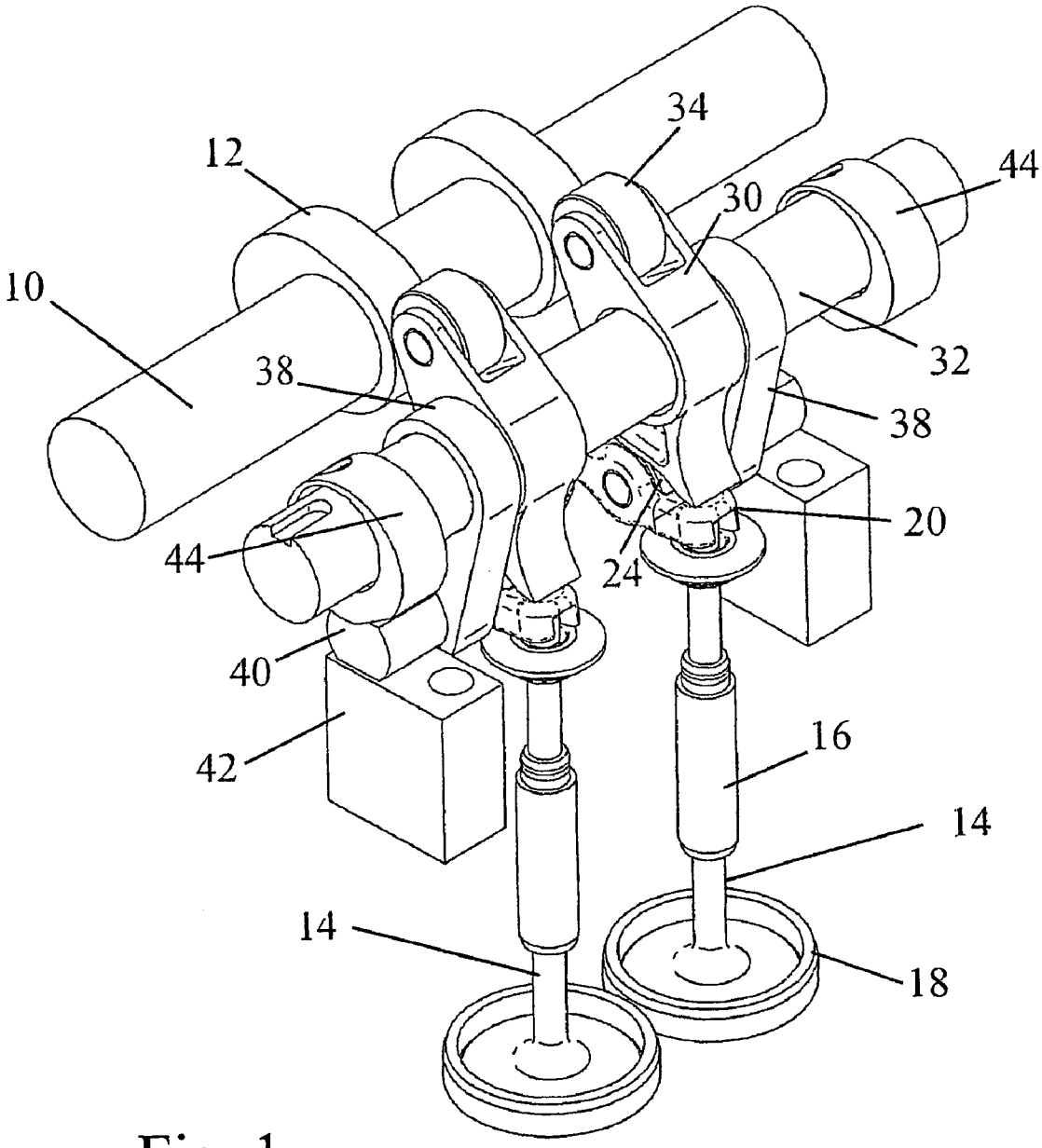
FIG. 1 is a perspective view of the valve mechanism of an engine of the present invention.
Figure 2:
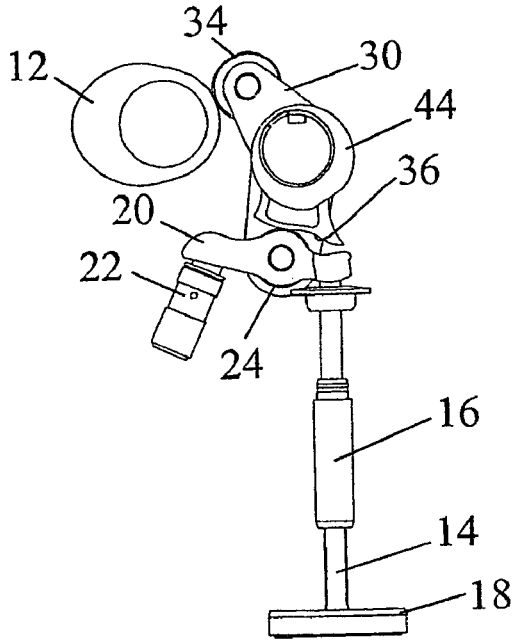
FIG. 2 shows an end view of the valve mechanism of FIG. 1 with the valve closed and the pivot shaft of the intermediate rocker in a position to achieve maximum valve lift.
Figure 3:
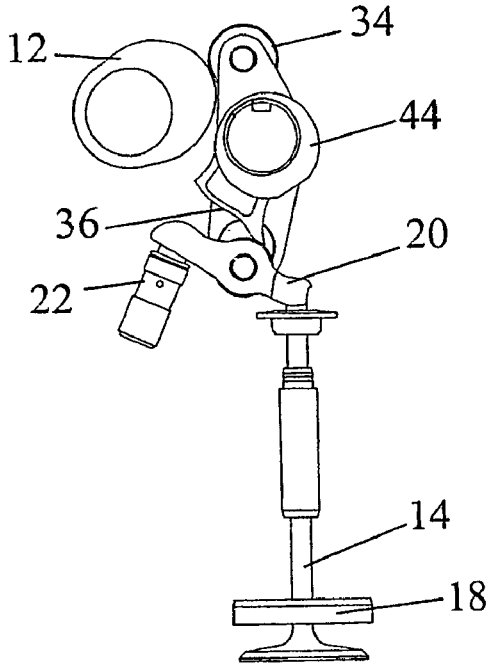
FIG. 3 shows an end view similar to that of FIG. 2, with the valve fully opened and the pivot shaft of the intermediate rocker in a position to achieve maximum valve lift.

In FIG. 2, the roller 24 is in contact with the contoured surface mid-way along its length when the cam follower roller 34 is in contact with the base circle of the cam 12. When the roller 34 moves on to the lobe of the cam 12, as shown in FIG. 3, the right hand end (as viewed) of the contoured surface 36 fully depresses the valve actuating rocker 20 to open the valve with maximum lift.

Figure 4:
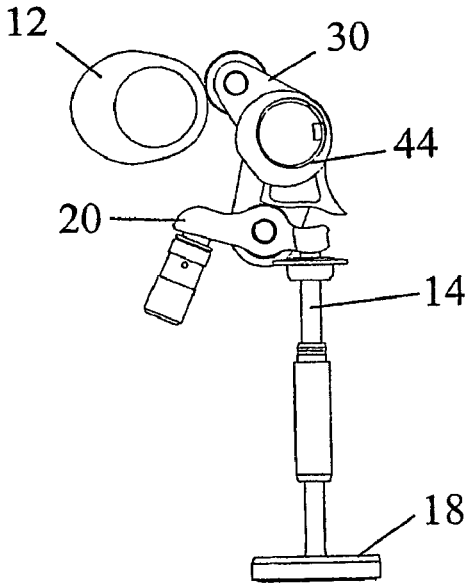
FIG. 4 shows an end view similar to that of FIG. 2, with the valve closed and the pivot shaft of the intermediate rocker in a position to achieve minimum valve lift.
Figure 5:
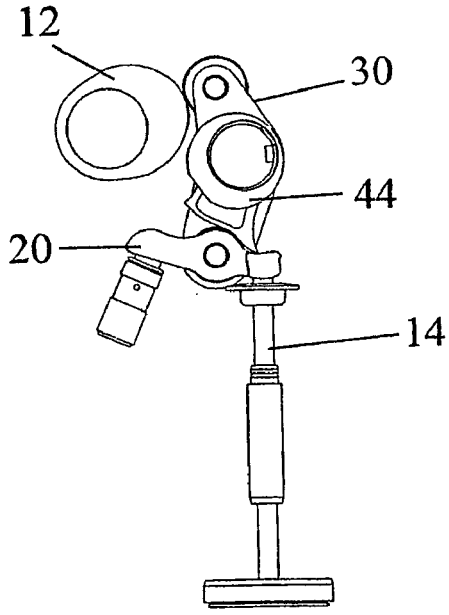
FIG. 5 shows an end view similar to that of FIG. 2, with the valve fully opened and the pivot shaft of the intermediate rocker in a position to achieve minimum valve lift.

By contrast, in FIG. 4, the pivot shaft 32 has been moved to the right so that when the roller 34 is on the base circle of the cam 12 the follower 24 is in contact with the contoured surface 36 near its left hand end. When, as shown in FIG. 5, the roller 34 moves on to the lobe of the cam 12, the follower 24 does not reach the right hand end of the contoured surface 36 and the valve is not opened to the same extent. Thus by moving the pivot shaft 32 from left to right, as viewed, the valve lift can be set to any desired value between its two limits.

It is important to ensure that the act of moving the shaft 32 to vary the valve lift does not affect the clearance between the roller 24 and the contoured surface 36. For this clearance to remain constant, the locus of the shaft 32 is required to be an arc centred on the axis of the follower roller 24.

In the illustrated embodiment of the invention, the shaft is constrained to move along such a path by means of a pair of links 38. The shaft 32 is rotatably mounted in the latter links 38 and the lower end of each link 38 is pivotably mounted on a respective pivot pin that is stationarily mounted in the engine with its axis in line with the axis of the follower rollers 24 of the valve actuating rockers 20. Each pin projects from a small block 40 that is bolted to a post 42 which forms part of the engine cylinder head.

Figure 7:
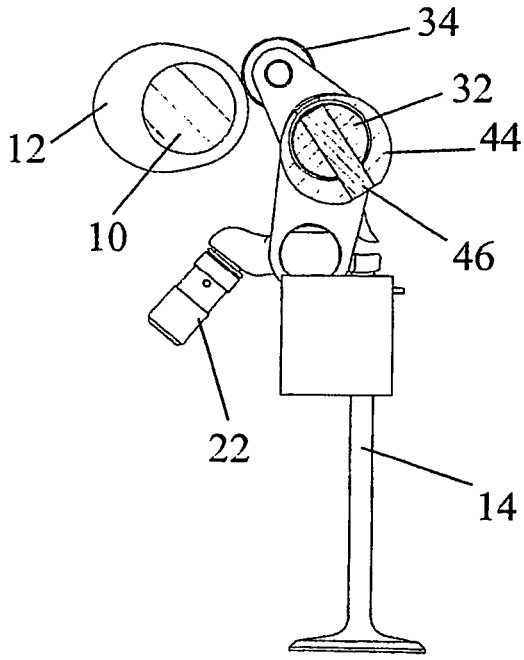
FIG. 7 is a section along the line A—A in FIG. 6.

The shaft 32 passes through two cylindrical bores formed in bearing blocks (not shown) which are secured to the engine cylinder head. Sleeves 44 with eccentric bores are interposed between the shaft 32 and the bearing blocks, the shaft 32 being received with clearance in the bores of the sleeves 44. Each sleeve 44 is coupled for rotation with the shaft 32 by means of a pin 46 (see FIG. 7) which is a sliding fit in at least one of the shaft 32 and the sleeve 44.

If the shaft 32 is rotated, the eccentric sleeves 44 will rotate in the bearing blocks and thereby displace the axis of the shaft. The clearance between the shaft 32 and the sleeves 44 and the sliding movement of the coupling pins are required because the path followed by the shaft 32 is dictated by the links 38 and not by the sleeves 44. The eccentric sleeves 44 serve merely as a convenient manner to urge the shaft 32 to the left or to the right uniformly along its length.

A phase changing mechanism 50 of any suitable design (of which there are numerous examples in the prior art) is used to vary the phase of the camshaft 10 in relation to the engine crankshaft. The phase change mechanism 50 may, for example, be used to compensate for the variation in event timing that accompanies the variation in valve lift achieved by the mechanism described.

It will be appreciated by the person skilled in the art that various modifications may be made to the described valve mechanism without departing from the scope of the invention as set out in the appended claims. For example, in the described embodiment, separate cams and intermediate rockers are employed to open the two valves of a cylinder, but it would be alternatively possible to employ a single intermediate rocker having a single cam follower and two profiled surfaces to act on the two valves. Such a construction permits both valves to be actuated concurrently by a single cam lobe.

As above described, the cam lobes 12 and the contoured surfaces 36 associated with the respective valves were assumed to be identical so that the two valves of a cylinder would always open at the same time and by the same amount as one another. It is alternatively possible however for the cam profiles and/or the contoured surfaces of the intermediate rockers actuating the two valves to have a different geometry from one another, such that the valve lift characteristics of the two valves differ from one another as the valve lift is reduced.

The invention claimed is:

1. An internal combustion engine having a crankshaft and a valve mechanism, wherein the valve mechanism comprises a gas exchange poppet valve, a camshaft rotatable in synchronism with the engine crankshaft and having a cam for operating the valve, a valve actuator acting on the poppet valve to open and close the valve, the valve actuator having a part-cylindrical contact surface, a pivot shaft that is moveable relative to the camshaft along a predetermined path in response to rotation of the pivot shaft about its own axis, and an intermediate rocker mounted on the pivot shaft and having a follower acted upon by the cam and a contoured surface that acts on the part-cylindrical contact surface of the valve actuator to open and close the valve in synchronism with the rotation of the cam, wherein movement of the pivot shaft along the predetermined path causes movement of intermediate rocker, and movement of the intermediate rocker in turn causes the valve lift to vary, and said predetermined path is such that, while the cam follower is on the base circle of the cam, the valve actuator remains stationary and a substantially constant clearance is maintained between the contoured surface of the intermediate rocker and the valve actuator during displacement of the pivot shaft along the path.

2. The engine of claim 1, wherein the pivot shaft is located on the intermediate rocker between the cam follower and the contoured surface.

3. The engine of claim 1, wherein the valve actuator is constructed as a valve actuating rocker pivoted at one end, acting on the valve at its other and having said part-cylindrical contact surface between its ends.

4. The engine of claim 3, wherein the pivot at the said one end of the valve actuating rocker comprises a hydraulic lash adjuster.

5. An internal combustion engine having a crankshaft and a valve mechanism, wherein the valve mechanism comprises:

a gas exchange poppet valve, a camshaft rotatable in synchronism with the engine crankshaft and having a cam for operating the valve, a valve actuator acting on the poppet valve to open and close the valve, the valve actuator being constructed as a valve actuating rocker pivoted at one end, acting on the valve at its other end and having between its ends a part-cylindrical contact surface or a roller follower acted upon by the contoured surface of the intermediate rocker, a pivot shaft that is moveable relative to the camshaft along a predetermined path in response to rotation of the pivot shaft about its own axis, and an intermediate rocker mounted on the pivot shaft and having a follower acted upon by the cam and a contoured surface that acts on the valve actuator to open and close the valve in synchronism with the rotation of the cam, wherein movement of the pivot shaft along the predetermined path causes movement of intermediate rocker, and movement of the intermediate rocker in turn causes the valve lift to vary, and said predetermined path is such that, while the cam follower is on the base circle of the cam, the valve actuator remains stationary and a substantially constant clearance is maintained between the contoured surface of the intermediate rocker and the valve actuator during displacement of the pivot shaft along the path, and wherein the pivot shaft is journalled in a link that constrains the pivot shaft of the intermediate rocker to move along an arc centered on the axis of the roller or cylindrical contact surface of the valve actuating rocker.

6. The engine of claim 5, wherein the pivot shaft passes with clearance through a bore in an eccentric sleeve rotatably supported in a stationary bearing block of the engine.

7. The engine of claim 6, wherein the eccentric sleeve is coupled to the shaft by means of a pin which is free to slide relative to at least one of the sleeve and the shaft.

8. The engine of claim 1, wherein a phase change mechanism is provided between the engine crankshaft and the camshaft.

9. The engine of claim 1, having two valve mechanisms controlling the flow of gas into or out of each engine cylinder, wherein the cam profiles and/or the contoured surfaces of the intermediate rockers actuating the two valves of each cylinder have a different geometry from one another, such that the valve lift characteristics of the two valves differ from one another as the valve lift is reduced.

10. The engine of claim 1, wherein said part-cylindrical contact surface is a surface of a roller follower.

* * * * *